US009055769B2

(12) United States Patent
Liao

(10) Patent No.: US 9,055,769 B2
(45) Date of Patent: Jun. 16, 2015

(54) CIGAR CUTTER WITH MAGNETIC OPENING AND CLOSING MECHANISM

(71) Applicant: Shun-Yi Liao, Yunlin County (TW)

(72) Inventor: Shun-Yi Liao, Yunlin County (TW)

( * ) Notice: Subject to any disclaimer, the term of this patent is extended or adjusted under 35 U.S.C. 154(b) by 269 days.

(21) Appl. No.: 13/668,386

(22) Filed: Nov. 5, 2012

(65) Prior Publication Data

US 2013/0180113 A1 Jul. 18, 2013

(30) Foreign Application Priority Data

Jan. 17, 2012 (TW) ..... 101201050 U

(51) Int. Cl.
*A24F 13/26* (2006.01)

(52) U.S. Cl.
CPC ..... *A24F 13/26* (2013.01)

(58) Field of Classification Search
CPC ..... A24F 13/20; A24F 13/24; A24F 13/26
USPC ..... 30/109–113; D27/195; 131/248–252
See application file for complete search history.

(56) References Cited

U.S. PATENT DOCUMENTS

| | | | | | |
|---|---|---|---|---|---|
| 257,925 | A | * | 5/1882 | Faas | 30/113 |
| 324,281 | A | * | 8/1885 | Veit | 30/113 |
| 519,332 | A | * | 5/1894 | Hopkins | 30/113 |
| 953,313 | A | * | 3/1910 | Astruck et al. | 30/113 |
| 958,610 | A | * | 5/1910 | Emrich | 30/113 |
| 1,058,999 | A | * | 4/1913 | Patten | 30/113 |
| 1,061,236 | A | * | 5/1913 | Fuller | 30/113 |
| 1,082,257 | A | * | 12/1913 | Astruck | 30/113 |
| 1,086,463 | A | * | 2/1914 | Robbins | 30/113 |
| 1,093,004 | A | * | 4/1914 | Merrill | 30/113 |
| D46,053 | S | * | 7/1914 | Kaufman | D27/195 |
| 1,119,220 | A | * | 12/1914 | Bates | 30/113 |
| D48,700 | S | * | 3/1916 | Astruck | D27/195 |
| 1,177,098 | A | * | 3/1916 | Gay | 30/112 |
| 1,186,291 | A | * | 6/1916 | Davis | 30/112 |
| 1,294,358 | A | * | 2/1919 | Henriot | 30/112 |
| 4,366,619 | A | * | 1/1983 | Bieganski | 30/113 |
| 5,947,280 | A | * | 9/1999 | Jimenez | 30/113 |
| 5,992,022 | A | * | 11/1999 | Carrera Moya | 30/113 |
| 6,708,409 | B2 | * | 3/2004 | Yu | 30/113 |
| D569,548 | S | * | 5/2008 | Smith | D27/195 |
| D577,151 | S | * | 9/2008 | Smith | D27/195 |

(Continued)

FOREIGN PATENT DOCUMENTS

| | | | |
|---|---|---|---|
| CH | 248911 A | * | 5/1947 |
| CN | 202958797 U | * | 6/2013 |

(Continued)

*Primary Examiner* — Jason Daniel Prone
(74) *Attorney, Agent, or Firm* — Bacon & Thomas, PLLC

(57) ABSTRACT

The present invention is a cigar cutter, which includes a housing having a hole through two corresponding sides and a first knife covering a part of the hole; a pressing portion movably embedded at one end of the housing and having a first magnetic element on one side thereof; and a knife holder movably embedded at one side of the housing and having a second magnetic element and a second knife. When the knife holder is displaced toward the housing, the first and second magnetic elements are connected together by magnetic attraction, and the first and second knives jointly cover the hole. When the pressing portion is displaced toward the housing, the first magnetic element is disconnected from the second magnetic element, and the knife holder is pushed and displaced by a spring to prevent the second knife from covering the hole that is not covered by the first knife.

4 Claims, 7 Drawing Sheets

(56) References Cited

U.S. PATENT DOCUMENTS

| | | | | | |
|---|---|---|---|---|---|
| D602,632 | S | * | 10/2009 | Smith | D27/195 |
| D617,496 | S | * | 6/2010 | Wong | D27/195 |
| 7,770,295 | B2 | * | 8/2010 | Smith | 30/113 |
| D623,352 | S | * | 9/2010 | Melgaard et al. | D27/195 |
| D630,794 | S | * | 1/2011 | Cohen Harel | D27/195 |
| 8,656,595 | B2 | * | 2/2014 | Wong | 30/113 |
| 2006/0249166 | A1 | * | 11/2006 | Lauzon | 131/248 |
| 2007/0000133 | A1 | * | 1/2007 | Kasuli | 30/113 |
| 2009/0113719 | A1 | * | 5/2009 | Smith | 30/113 |
| 2009/0211589 | A1 | * | 8/2009 | Smith | 131/248 |
| 2011/0302785 | A1 | * | 12/2011 | Chuan | 30/113 |
| 2014/0082945 | A1 | * | 3/2014 | Lance et al. | 30/112 |
| 2015/0000140 | A1 | * | 1/2015 | Lance et al. | 30/112 |

FOREIGN PATENT DOCUMENTS

| | | | | |
|---|---|---|---|---|
| DE | 943622 | C | * | 5/1956 |
| EP | 2183987 | A1 | * | 5/2010 |
| FR | 1413220 | A | * | 10/1965 |
| FR | 2821580 | A1 | * | 9/2002 |
| FR | 2827538 | A1 | * | 1/2003 |
| GB | 190902384 | A | * | 0/1909 |
| GB | 191325661 | A | * | 0/1914 |
| GB | 191517189 | A | * | 10/1916 |
| GB | 232455 | A | * | 4/1925 |
| GB | 1005914 | A | * | 9/1965 |

* cited by examiner

CIGAR CUTTER WITH MAGNETIC OPENING AND CLOSING MECHANISM

FIELD OF THE INVENTION

The present invention relates to a cigar cutter, more particularly to a cigar cutter with magnetic opening and closing mechanism through using magnetic elements, so as to enable the cigar cutter to be opened rapidly and resume a closed position as soon as a cigar is cut.

BACKGROUND OF THE INVENTION

With the improvement of living standards, cigars as a relatively expensive form of tobacco have become increasingly popular. Before a cigar can be smoked, it is required to cut off one closed end of the cigar (generally known as the cap), render the cut into a hollow shape, and light the other end of the cigar (generally known as the foot). Nowadays, the cigar cap is typically cut off with a cigar cutter, as opposed to being bitten off by the smoker. After all, biting the cap off not only will fill the smoker's mouth with tobacco, but also will make a ragged cut that prevents the cigar from burning evenly when smoked. This is undesirable because, should a cigar burn unevenly, the taste and flavor of the cigar will be compromised. Only with a cigar cutter can a smooth cut be made on a cigar to bring out the most flavor of the cigar and, for esthetic reasons, keep the cigar wrapper from fraying.

A common cigar cutter is now briefly described with reference to FIGS. 1 and 2. The cigar cutter 1 includes a bottom housing portion 11, a top housing portion 13, a fixed handle 15, and a movable handle 17. The bottom housing portion 11 and the top housing portion 13 are put together to form a housing 10 (see FIG. 2). The bottom housing portion 11 and the top housing portion 13 are respectively formed with through holes 110, 130 that correspond to each other and penetrate the bottom housing portion 11 and the top housing portion 13 respectively. The bottom housing portion 11 has one end coupled to one end of the fixed handle 15. A fixed knife 151 is received between the bottom housing portion 11 and the top housing portion 13 and has a blade partially covering the through holes 110, 130. One end of the movable handle 17 is movably provided at the other end of the bottom housing portion 11 and extends into the housing 10 (i.e., in between the bottom housing portion 11 and the top housing portion 13). This end of the movable handle 17 is provided with a movable knife 171 which, once the movable handle 17 is moved to a position defining the closed state of the cigar cutter 1, covers the remaining part of the through holes 110, 130 completely. When the movable handle 17 is so moved that the cigar cutter 1 enters the open state, the movable knife 171 leaves the aforesaid remaining part of the through holes 110, 130 totally uncovered (see FIG. 2). A user may insert the cap 2 of a cigar into the through holes 110, 130 when the cigar cutter 1 is in the open state and then, by pushing the movable handle 17, bring the cigar cutter 1 into the closed state to cut off the cap 2 smoothly.

However, the cigar cutter 1 has its drawbacks in use. First of all, referring back to FIG. 1, the movable handle 17 must be manually pulled or pushed in order to open or close the cigar cutter 1. Secondly, when the cigar cutter 1 is in the open state, no positioning effect is provided. Therefore, to keep the cigar cutter 1 in the open state, a user must apply forces to the handles 15, 17 of the cigar cutter 1 continuously, preventing the movable knife 171 from covering the aforesaid remaining part of the through holes 110, 130; otherwise, the user may have problem inserting the cap 2 into the through holes 110, 130. It can be known from the above that the conventional cigar cutter 1 still has room for improvement, particularly in terms of convenience of use.

Given the high prices of cigars, cigar accessories are very expensive, too; nevertheless, cigar aficionados have shown strong consumption power and are willing to spend on these accessories. Of the various cigar accessories, cigar cutters are undoubtedly an indispensable item to be carried around by cigar smokers. Hence, a practical, easily operable, and esthetically pleasing cigar cutter is bound to be a highly sought-after product among cigar enthusiasts and will create tremendous profit for the manufacturer. The problem facing the cigar-related product industry nowadays is to design a novel cigar cutter structure which can overcome the drawbacks of the conventional cigar cutters and provide enhanced convenience of use.

BRIEF SUMMARY OF THE INVENTION

In view of the drawbacks of the conventional cigar cutters during use, the inventor of the present invention conducted extensive research and experiment and finally succeeded in developing a cigar cutter with a magnetic opening and closing mechanism as disclosed herein. The disclosed cigar cutter is more convenient than the prior art devices and can solve the aforementioned problems effectively.

It is an object of the present invention to provide a cigar cutter having a magnetic opening and closing mechanism, wherein the cigar cutter includes a housing, a pressing portion, and a knife holder. The housing has two corresponding sides each provided with a through hole. A block is provided in the housing and is adjacent to the through holes. A first knife is also provided in the housing and covers a part of the through holes. The pressing portion is movably embedded at one end of the housing and has one end exposed from the housing and an opposite end extending into the housing. A pressing spring is provided between the pressing portion and the block. At least one side of the pressing portion is provided with a first magnetic element. The knife holder is movably embedded at one side of the housing and has one end exposed from the housing and an opposite end extending into the housing. The knife holder is embedded with a second magnetic element corresponding in position to the pressing portion. An opening/closing spring is provided between the knife holder and the block. The knife holder is provided with a second knife. When the knife holder is displaced toward the housing such that the second magnetic element is connected to the corresponding first magnetic element by magnetic attraction, the knives jointly cover the through holes. When the pressing portion is displaced toward the through holes such that the at least one first magnetic element is disconnected from the second magnetic element, the knife holder is pushed and displaced by the opening/closing spring to prevent the second knife from covering the part of the through holes that is not covered by the first knife. Therefore, a user only has to press the pressing portion, and the cigar cutter will open rapidly; as soon as a cigar is cut, the knife holder resumes the closed position. Thus, the cigar cutter features great convenience of use.

In another embodiment of the present invention, the foregoing cigar cutter is additionally provided with a second knife holder, and the first knife is provided on the second knife holder. The second knife holder is movably embedded at an opposite side of the housing and, like the first knife holder, has one end exposed from the housing and an opposite end extending into the housing. The second knife holder is embedded with another second magnetic element corresponding in position to the pressing portion, and another opening/closing spring is provided between the second knife holder and the block. Thus, the first knife holder and the second knife holder can cause the knives to jointly cover or not cover the through holes, depending on whether the second magnetic elements and the at least one first magnetic element are connected by magnetic attraction. This embodiment provides an even more convenient mode of operation.

BRIEF DESCRIPTION OF THE SEVERAL VIEWS OF THE DRAWINGS

The structure as well as a preferred mode of use, further objects, and advantages of the present invention will be best understood by referring to the following detailed description of some illustrative embodiments in conjunction with the accompanying drawings, in which.

DETAILED DESCRIPTION OF THE INVENTION

Figure 1:
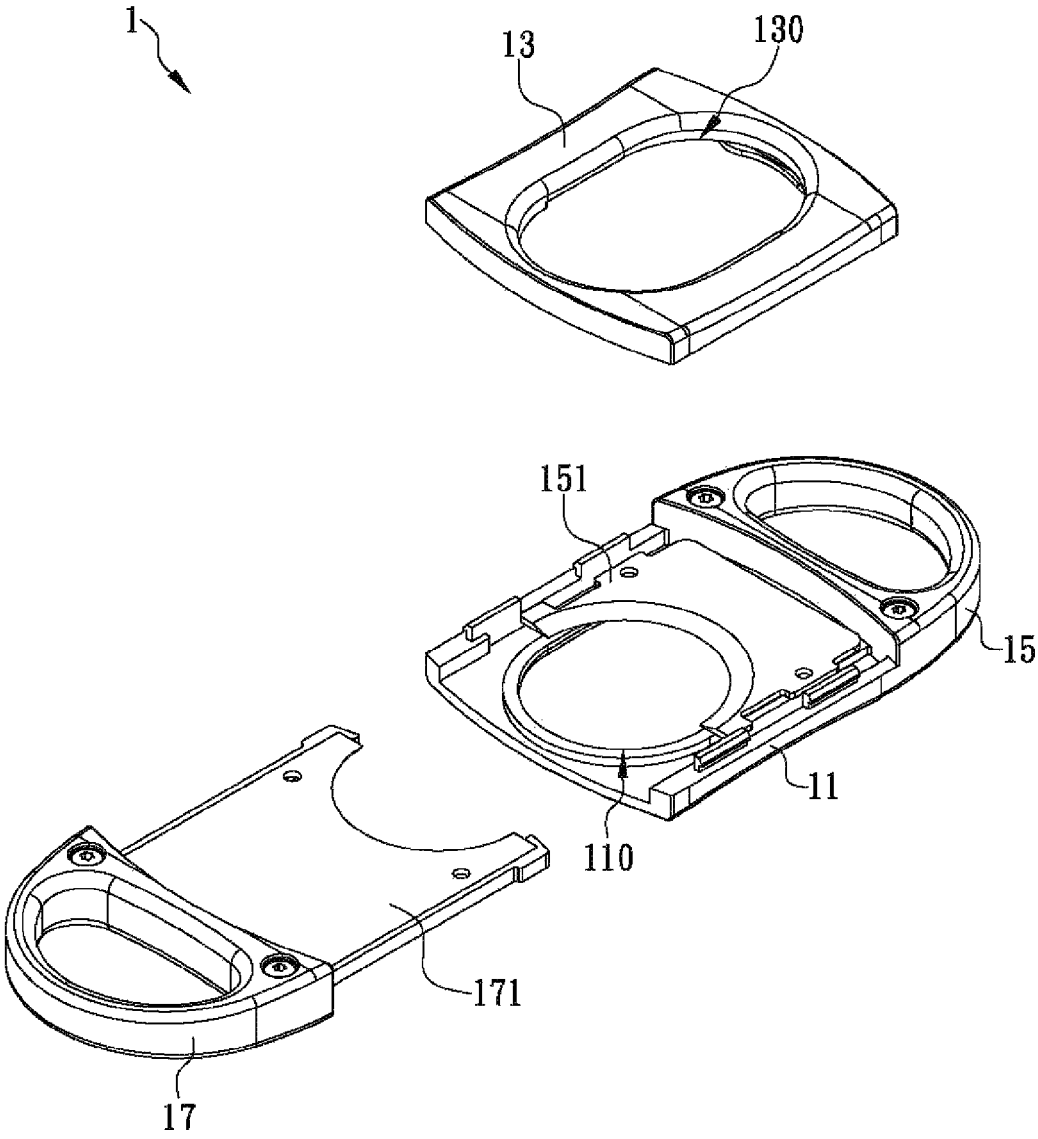
FIG. 1(Prior Art)
FIG. 1 is an exploded perspective view of a conventional cigar cutter.
Figure 2:
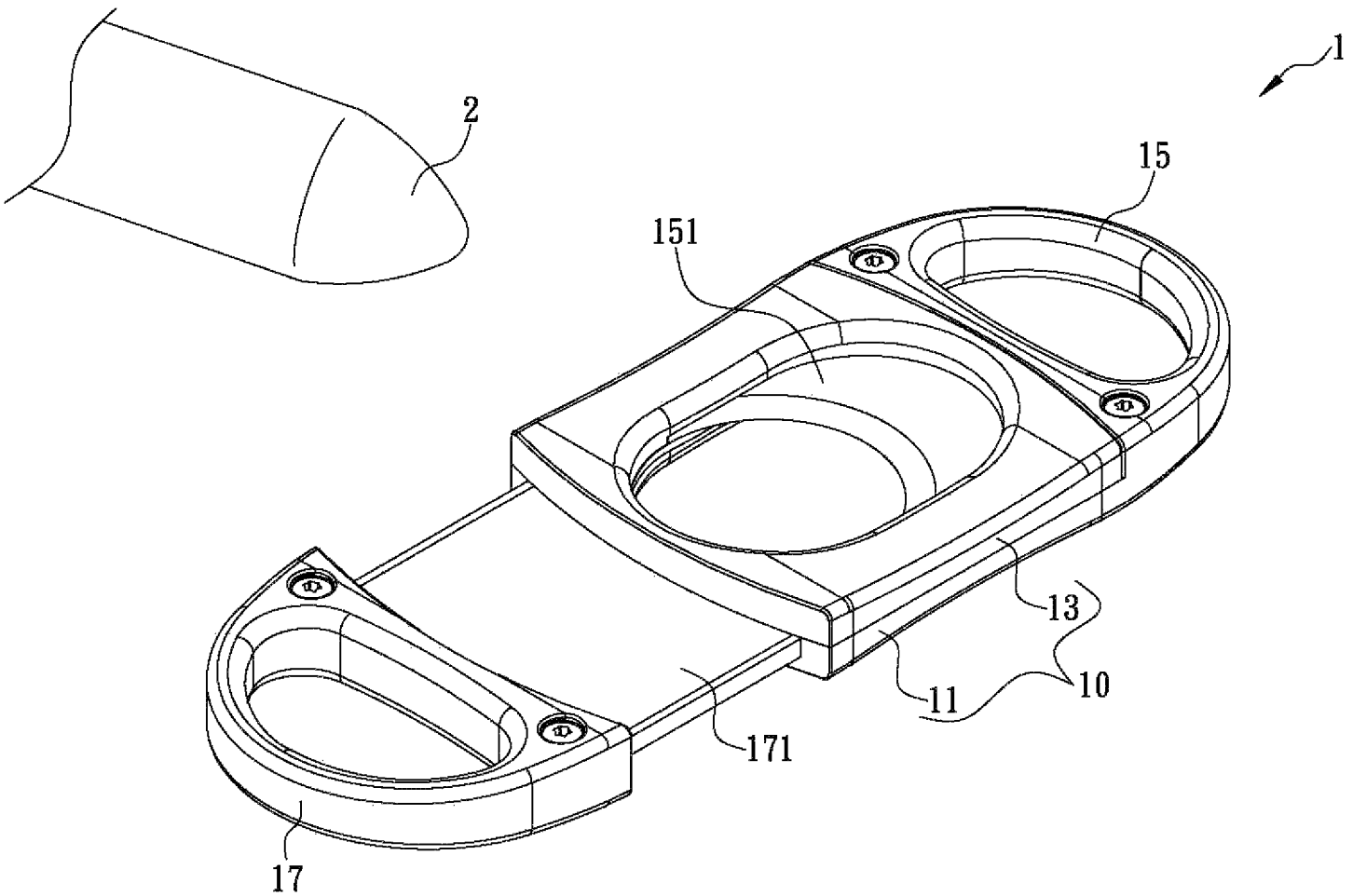
FIG. 2(Prior Art)
FIG. 2 is an assembled perspective view of the conventional cigar cutter depicted in FIG. 1.
Figure 3:
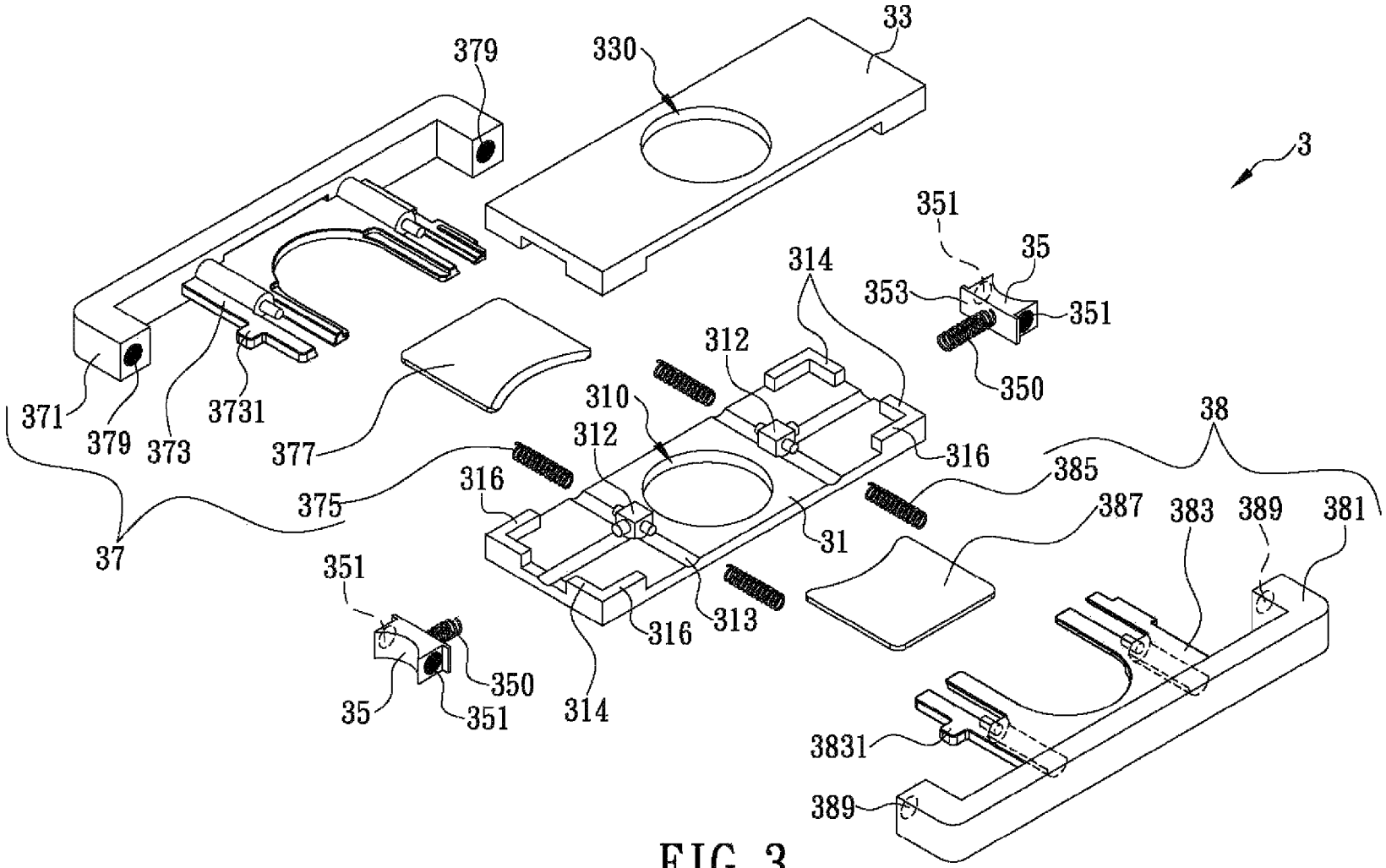
FIG. 3 is an exploded perspective view of the cigar cutter in an embodiment of the present invention.

The present invention discloses a cigar cutter with a magnetic opening and closing mechanism. In order for the general public to rapidly understand the technical features of the present invention, a preferred embodiment of the present invention is provided herein. However, the shape of each element in the preferred embodiment may vary according to product design in a different embodiment of the present invention. Reference is now made to FIG. 3, in which the connections between elements are described based on the directions defined below: the front side of an element is directed toward the upper right corner of FIG. 3; the rear side, toward the lower left corner of FIG. 3; the right side, toward the lower right corner of FIG. 3; the left side, toward the upper left corner of FIG. 3; the upper side, toward the top side of FIG. 3; and the lower side, toward the bottom side of FIG. 3.

As shown in FIG. 3, the cigar cutter 3 includes a bottom housing portion 31, a top housing portion 33, two pressing portions 35, a left knife holder 37, and a right knife holder 38. The bottom housing portion 31 is provided with a first through hole 310 which penetrates two corresponding sides of the bottom housing portion 31. The inner side of the bottom housing portion 31 is protrudingly provided with two blocks 312 which extend upward and are respectively adjacent to the front side and the rear side of the first through hole 310. In addition, the bottom housing portion 31 is provided with a groove 313 corresponding in position to each of the front, left, and right sides of the front block 312 and each of the rear, left, and right sides of the rear block 312. The inner side of the bottom housing portion 31 has a front edge and a rear edge each provided with two spaced-apart first stop members 314. The inner side of the bottom housing portion 31 also has a left edge and a right edge each provided with two spaced-apart second stop members 316. The top housing portion 33, on the other hand, is provided with a second through hole 330 which penetrates two corresponding sides of the top housing portion 33. The top housing portion 33 corresponds in configuration to the bottom housing portion 31 and is fixedly engaged with the bottom housing portion 31 to form a housing 30 (see FIG. 4) in which a receiving space 300 is defined and the second through hole 330 corresponds to the first through hole 310. It should be pointed out that the blocks 312, the grooves 313, the first stop members 314, and the second stop members 316 may be provided on the inner side of the top housing portion 33 instead or be provided on both the bottom housing portion 31 and the top housing portion 33 rather than on the bottom housing portion 31 alone. Besides, in order to form the housing 30 of the present invention, the bottom housing portion 31 and the top housing portion 33 may be connected by an adhesive, locking, or other means.

Figure 4:
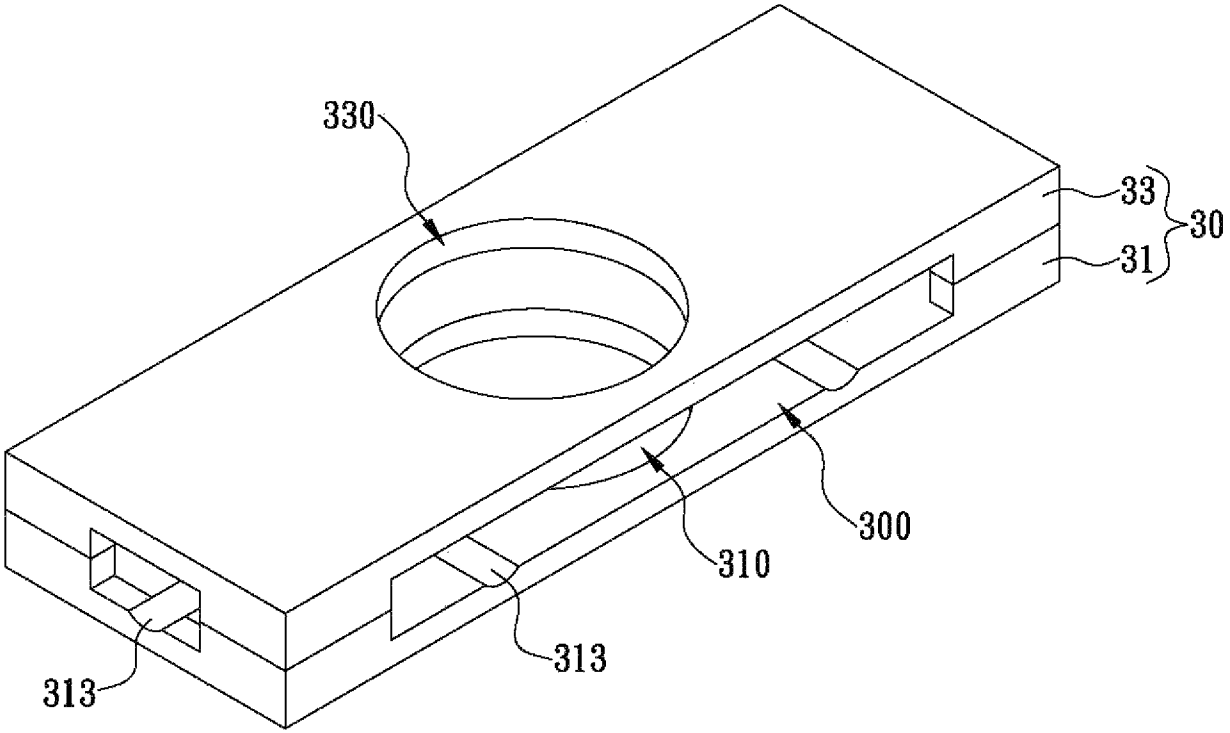
FIG. 4 is a perspective view of the housing of the present invention.

Referring to FIGS. 3 and 4, the two pressing portions 35 are respectively and movably embedded at the front end and the rear end of the housing 30. Each pressing portion 35 has a first end exposed from the housing 30 and a second end extending into the receiving space 300 through the gap between the corresponding two first stop members 314. A pressing spring 350 is provided between each pressing portion 35 and the corresponding block 312. Each pressing spring 350 applies a force to the corresponding pressing portion 35 to drive the corresponding pressing portion 35 away from the housing 30. The pressing springs 350 are respectively received in the groove 313 corresponding to the front side of the front block 312 and the groove 313 corresponding to the rear side of the rear block 312, so as not to bend and shift away from their predetermined positions when respectively compressed by the pressing portions 35. Should such shifts in position take place, the pressing portions 35 cannot be operated normally. The left and right sides of each pressing portion 35 are each provided with a main magnetic element 351. Each pressing portion 35 is further provided with at least one stop plate 353 adjacent to the second end thereof. Each stop plate 353 can press against the corresponding first stop members 314, keeping the second end of each pressing portion 35 within the housing 30 and thereby preventing the pressing portions 35 from separation from the housing 30.

Figure 5A:
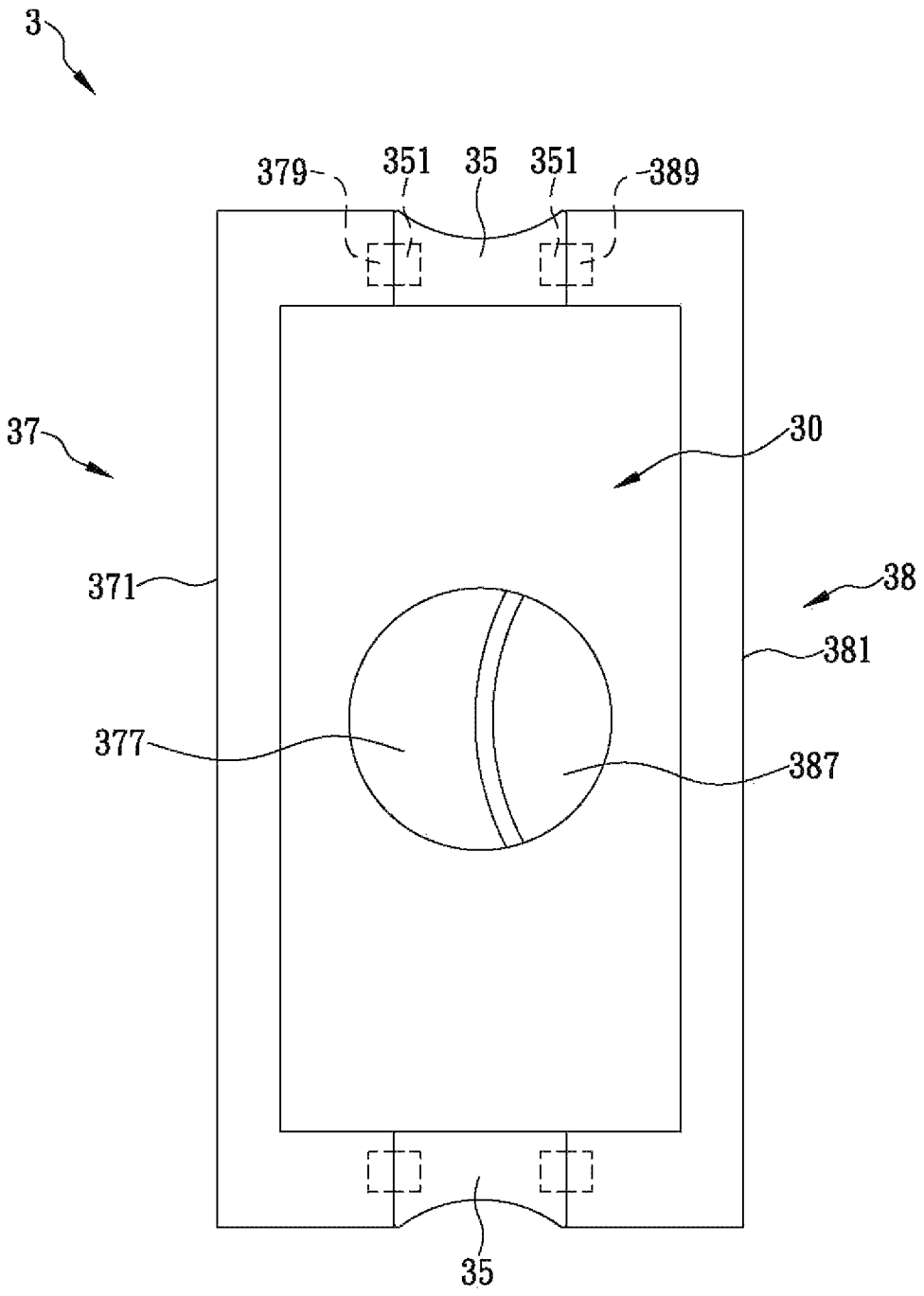
FIG. 5A schematically shows the closed state of the cigar cutter of the present invention.
Figure 5B:
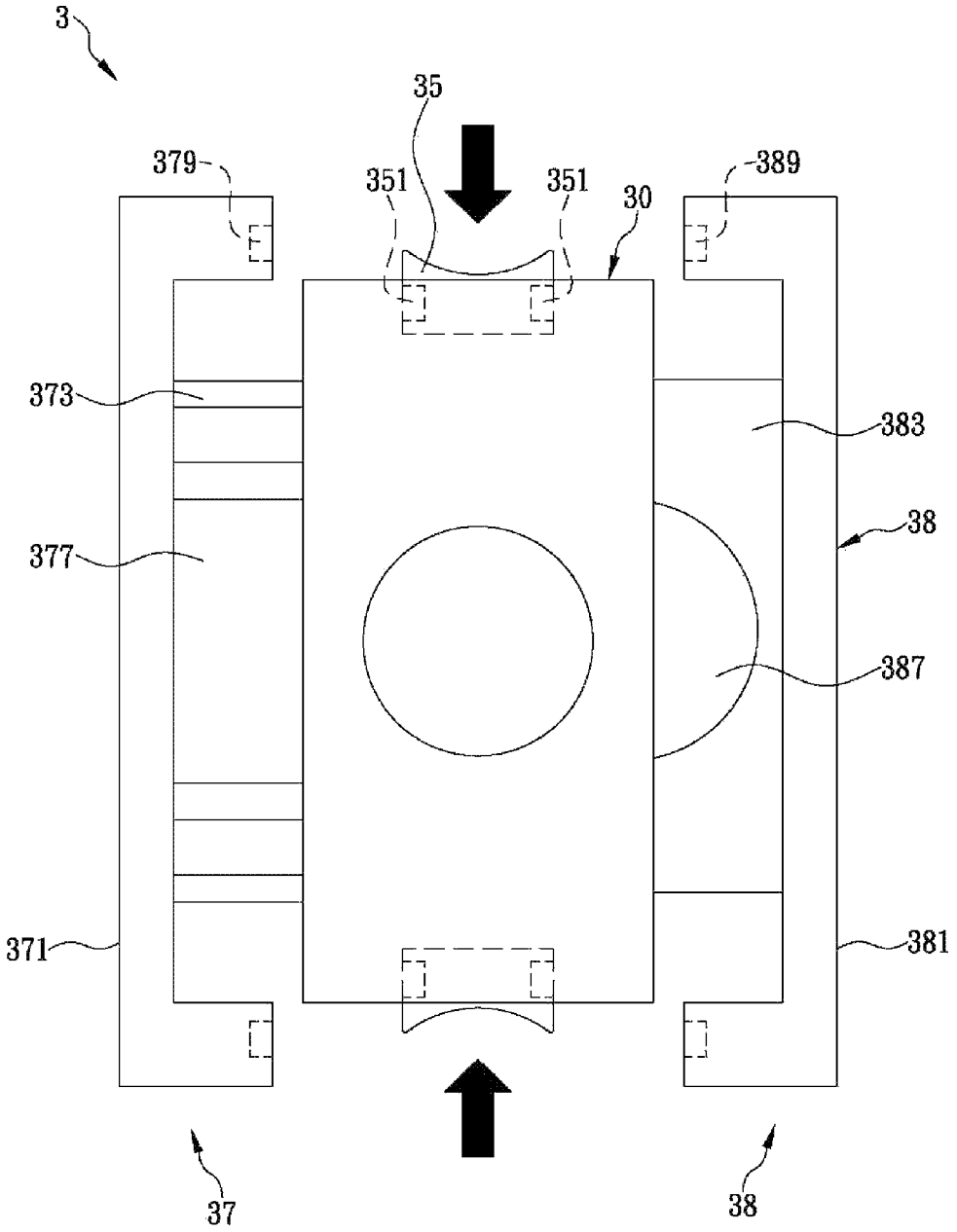
FIG. 5B schematically shows the open state of the cigar cutter of the present invention.

Referring again to FIGS. 3 and 4, the left knife holder 37 is movably embedded at the left side of the housing 30 and includes a left frame 371, a left sliding plate 373, two left springs 375, and a left knife 377. In this embodiment, the left frame 371 is generally C-shaped and is exposed from the housing 30. The two ends of the left frame 371 extend toward the pressing portions 35 respectively and are each embedded with a left magnetic element 379, wherein each left magnetic element 379 is connectable to the corresponding main magnetic element 351 by magnetic attraction. The left sliding plate 373 is fixed to the left frame 371, extends into the receiving space 300 through the gap between the corresponding two second stop members 316, and can be displaced in the receiving space 300 toward the left and right. The upper side of the left sliding plate 373 has two corresponding ends (e.g., the posts shown in FIG. 3). The left springs 375 are respectively provided between these two ends and the blocks 312 so as to apply a force to the left sliding plate 373 that tends to drive the left sliding plate 373 away from the housing 30. More specifically, the left springs 375 are respectively received in the groove 313 corresponding to the left side of the front block 312 and the groove 313 corresponding to the left side of the rear block 312. The left sliding plate 373 is further provided with at least one left stopper 3731 which can press against the corresponding second stop members 316 to prevent the left sliding plate 373 from separation from the housing 30. The left knife 377 is provided on the upper side of the left sliding plate 373 and has a blade facing the through holes 310, 330. Referring to FIG. 5A, when the left frame 371 and the left sliding plate 373 are displaced toward the housing 30 such that the left magnetic elements 379 are respectively connected to the left-side main magnetic elements 351 of the pressing portions 35 by magnetic attraction, the left knife 377 covers at least the left half of the first and second through holes 310, 330. Referring to FIG. 5B, when the pressing portions 35 are displaced toward the first through hole 310 and the second through hole 330 such that the left-side main magnetic elements 351 of the pressing portions 35 are disconnected from the left magnetic elements 379, the left frame 371 and the left sliding plate 373 are pushed and displaced by the two left springs 375; as a result, the left knife 377 no longer covers the first and second through holes 310, 330.

Referring again to FIGS. 3 and 4, the right knife holder 38 is movably embedded at the right side of the housing 30 and has the same basic structure as the left knife holder 37, except that some of the elements are upside down in comparison with the corresponding elements on the left knife holder 37. The structure of the right knife holder 38 is described only briefly as follows. The right knife holder 38 includes a right frame 381, a right sliding plate 383, two right springs 385, and a right knife 387. The right frame 381 is also generally C-shaped and is exposed from the housing 30. The two ends of the right frame 381 extend toward the pressing portions 35 respectively and are each embedded with a right magnetic element 389. The right sliding plate 383 is fixed to the right frame 381, extends into the receiving space 300 through the gap between the corresponding two second stop members 316, and can be displaced in the receiving space 300 toward the left and right. The right sliding plate 383 is further provided with at least one right stopper 3831 which can press against the corresponding second stop members 316 and thereby prevent the right sliding plate 383 from separation from the housing 30. The lower side of the right sliding plate 383 has two corresponding ends (e.g., the dash-lined posts in FIG. 3). The right springs 385 are respectively provided between these two ends and the blocks 312 so as to apply a force to the right sliding plate 383 that tends to drive the right sliding plate 383 away from the housing 30. More specifically, the right springs 385 are respectively received in the groove 313 corresponding to the right side of the front block 312 and the groove 313 corresponding to the right side of the rear block 312. The right knife 387 is provided on the lower side of the right sliding plate 383. Referring to FIG. 5A, when the right frame 381 and the right sliding plate 383 are displaced toward the housing 30 such that each right magnetic element 389 is connected to the right-side main magnetic element 351 of the corresponding pressing portion 35 by magnetic attraction, the right knife 387 covers at least the right half of the first and second through holes 310, 330. Referring to FIG. 5B, when the pressing portions 35 are displaced toward the first through hole 310 and the second through hole 330 such that the right-side main magnetic elements 351 of the pressing portions 35 are disconnected from the right magnetic elements 389, the right frame 381 and the right sliding plate 383 are pushed and displaced by the two right springs 385, and the right knife 387 is thereby kept from covering the first and second through holes 310, 330.

To use the cigar cutter 3, referring to FIGS. 3 through 5B, the pressing portions 35 are pressed to disconnect the main magnetic elements 351 from the corresponding left and right magnetic elements 379, 389. As a result, the forces respectively applied by the left and right springs 375, 385 to the left and right sliding plates 373, 383 become greater than the magnetic attraction forces between the main magnetic elements 351 and the corresponding left and right magnetic elements 379, 389. And because of that, the left and right knife holders 37, 38 are displaced away from the housing 30, and the cigar cutter 3 enters the open state, in which the first and second through holes 310, 330 are not covered by the left knife 377 or the right knife 387, and in which the cap of a cigar can be inserted into the first and second through holes 310, 330. As the left and right springs 375, 385 continue pushing the left and right sliding plates 373, 383 respectively, the cigar cutter 3 can stay in the open state without the user having to apply additional forces to the left and right knife holders 37, 38. When the user holding the cigar cutter 3 subsequently forces the left and right knife holders 37, 38 toward the housing 30 such that the left and right knives 377, 387 cover the first and second through holes 310, 330, the cigar cap is cut off. In the meantime, the pressing portions 35, which are respectively pushed by the corresponding pressing springs 350, resume their original positions, allowing the left and right magnetic elements 379, 389 to connect to the corresponding main magnetic elements 351 by magnetic attraction; thus, the cigar cutter 3 enters the closed state. As the magnetic attraction forces between the main magnetic elements 351 and the corresponding left and right magnetic elements 379, 389 are in this state greater than the forces respectively applied by the left and right springs 375, 385 to the left and right sliding plates 373, 383, the cigar cutter 3 will stay in the closed state. According to the above description, one who wishes to use the cigar cutter 3 of the present invention only has to press the pressing portions 35, and the cigar cutter 3 will open immediately; once a cigar is cut, the left and right knife holders 37, 38 close rapidly. Compared with the prior art, the convenience of use of the cigar cutter 3 is significantly increased.

Figure 6:
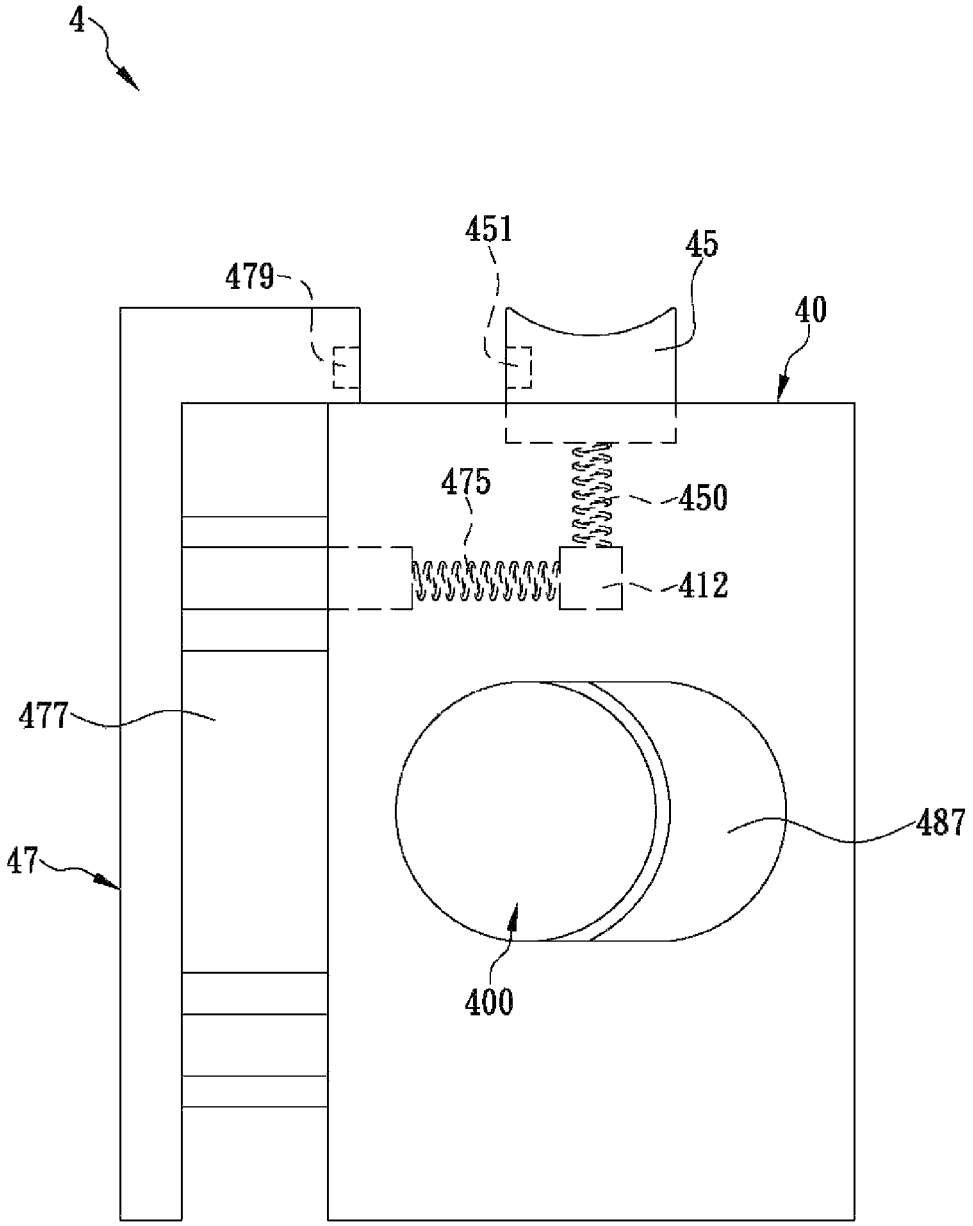
FIG. 6 is a schematic drawing of the cigar cutter in another embodiment of the present invention.

The shape of each element in the embodiment described above may be changed according to production requirements. For example, the frames may have an L shape instead such that only one end of each frame extends to the corresponding pressing portion. It is even feasible to provide only one pressing portion and only one knife holder. In the following embodiment, as shown in FIG. 6, the pushing mechanism and connection between the knife holder and the housing are the same as those in the previous embodiment and therefore will not be described repeatedly. FIG. 6 shows only the technical features that distinguish the two embodiments. The cigar cutter 4 in FIG. 6 includes a housing 40, a pressing portion 45, a knife holder 47, and a fixed knife 487. The housing 40 has two corresponding sides each provided with a through hole 400. The fixed knife 487 is provided in the housing 40 and covers a part of the through holes 400. A block 412 is provided in the housing 40 and is adjacent to the through holes 400. The pressing portion 45 is movably provided at one end of the housing 40 and has one end exposed from the housing 40 and an opposite end extending into the housing 40. A pressing spring 450 is provided between the pressing portion 45 and the block 412. The pressing portion 45 has one side provided with a first magnetic element 451. The knife holder 47 is movably embedded at one side of the housing 40 and has one end exposed from the housing 40 and an opposite end extending into the housing 40. The knife holder 47 is embedded with a second magnetic element 479 corresponding in position to the pressing portion 45. An opening/closing spring 475 is provided between the knife holder 47 and the block 412. The knife holder 47 is provided with a movable knife 477. When the knife holder 47 is displaced toward the housing 40 such that the second magnetic element 479 is connected to the first magnetic element 451 by magnetic attraction, the knives 477,

487 jointly cover the through holes 400, wherein the movable knife 477 covers the part of the through holes 400 that is not covered by the fixed knife 487. When the pressing portion 45 is displaced toward the through holes 400 such that the first magnetic element 451 is disconnected from the second magnetic element 479, the knife holder 47 is pushed and displaced by the opening/closing spring 475 to prevent the knives 477, 487 from covering the through holes 400 completely. The movable knife 477 in this state does not cover the part of the through holes 400 that is left uncovered by the fixed knife 487.

While the invention herein disclosed has been described by means of specific embodiments, numerous modifications and variations could be made thereto by those skilled in the art without departing from the scope of the invention set forth in the claims.

What is claimed is:

1. A cigar cutter, comprising:

a housing having two corresponding sides each provided with a through hole, and the housing being provided therein with a block adjacent to the through holes;

a first knife provided in the housing and covering a part of the through holes;

a pressing portion movably embedded at an end of the housing, said pressing portion having a first end exposed from the housing and a second end extending into the housing, wherein a pressing spring is disposed between said pressing portion and said block, and said pressing portion has one side provided with a first magnetic element; and a knife holder movably embedded at another end of the housing, said knife holder having a first end exposed from the housing and a second end extending into the housing, said knife holder being embedded with a second magnetic element corresponding in position to said pressing portion, wherein an opening/closing spring is provided between said knife holder and said block, said knife holder is provided with a second knife, wherein when the knife holder is moved toward the housing such that the second magnetic element is respectively connected to the first magnetic element by magnetic attraction, the first and second knives jointly cover the through holes; or when the pressing portion is moved toward the through holes such that the first magnetic element is disconnected from the second magnetic element, and the knife holder is pushed and moved by said opening/closing spring for keeping the second knife from covering a remaining part of the through holes.

2. The cigar cutter of claim 1, wherein the second end of said pressing portion is provided with a stop plate, and the housing is provided therein with a first stop member, the stop plate is configured to press against corresponding said first stop member and thereby keep the second end of said pressing portion within the housing.

3. The cigar cutter of claim 2, wherein the second end of said knife holder is provided with a stopper, and the housing is provided therein with a second stop member, and the stopper is configured to press against said second stop member and thereby keep the second end of said knife holder within the housing.

4. The cigar cutter of claim 3, wherein said knife holder comprises:

a frame exposed from the housing, wherein the frame has one end extending toward said pressing portion and embedded with said second magnetic element; and a sliding plate fixed to the frame, provided with said second knife, extending into the housing, and movable in the housing, wherein said opening/closing spring is provided between one end of the sliding plate and said block, said opening/closing spring is applying a force to the sliding plate to drive the sliding plate away from the housing, and said stopper is provided on the sliding plate.

* * * * *